US006696394B1

(12) United States Patent
Ruhr et al.

(10) Patent No.: US 6,696,394 B1
(45) Date of Patent: Feb. 24, 2004

(54) CONVEYOR LUBRICANTS FOR USE IN THE FOOD AND BEVERAGE INDUSTRIES

(75) Inventors: Richard O. Ruhr, Buffalo, MN (US); Gerald Wichman, Maple Grove, MN (US); Cathy Paquette, Coon Rapids, MN (US); Tim Gutzman, Eagan, MN (US)

(73) Assignee: Ecolab Inc., Mendota Heights, MN (US)

( * ) Notice: Subject to any disclaimer, the term of this patent is extended or adjusted under 35 U.S.C. 154(b) by 0 days.

(21) Appl. No.: 10/294,851

(22) Filed: Nov. 14, 2002

(51) Int. Cl.[7] ..... C10M 141/02; C10M 141/08
(52) U.S. Cl. ..... 508/405; 508/413; 508/416
(58) Field of Search ..... 508/405, 413, 508/416

(56) References Cited

U.S. PATENT DOCUMENTS

| | | | | | |
|---|---|---|---|---|---|
| 2,951,809 | A | * | 9/1960 | Nelson | 508/405 |
| 3,320,212 | A | * | 5/1967 | Shen et al. | 528/173 |
| 3,414,517 | A | * | 12/1968 | Mosier et al. | 508/405 |
| 3,574,101 | A | * | 4/1971 | Murphy | 508/389 |
| 4,521,321 | A | | 6/1985 | Anderson et al. | 252/49.3 |
| 4,556,496 | A | * | 12/1985 | Glova | 508/405 |
| 4,735,735 | A | * | 4/1988 | Borggrefe et al. | 508/405 |
| 5,062,978 | A | * | 11/1991 | Weber et al. | 508/500 |
| 5,250,203 | A | | 10/1993 | Denis et al. | 252/18 |
| 5,329,030 | A | * | 7/1994 | Schenker et al. | 554/98 |
| 5,723,418 | A | | 3/1998 | Person Hei et al. | 508/511 |
| 5,863,874 | A | | 1/1999 | Person Hei et al. | 508/521 |
| 5,900,392 | A | * | 5/1999 | Bernhard | 508/154 |
| 5,925,601 | A | | 7/1999 | McSherry et al. | 508/425 |
| 5,932,526 | A | | 8/1999 | Person Hei et al. | 508/559 |
| 5,935,914 | A | | 8/1999 | Theyssen et al. | 508/517 |
| 6,207,622 | B1 | | 3/2001 | Li et al. | 508/208 |

FOREIGN PATENT DOCUMENTS

| | | |
|---|---|---|
| EP | 0372628 | 10/1996 |

* cited by examiner

*Primary Examiner*—Jaccqueline V. Howard
(74) *Attorney, Agent, or Firm*—Vidas, Arrett & Steinkraus

(57) ABSTRACT

A lubricant concentrate comprising an effective lubricating amount of at least one sulfo methyl ester, and methods of using the same. The lubricant concentrate may diluted with water prior to use.

41 Claims, No Drawings

CONVEYOR LUBRICANTS FOR USE IN THE FOOD AND BEVERAGE INDUSTRIES

FIELD OF THE INVENTION

The present invention relates to lubricant concentrates and lubricant use compositions which include at least one sulfo methyl ester compound, and in particular to lubricant compositions which are employed as conveyor lubricants for use in the food and beverage industries, and to methods of using the same.

BACKGROUND OF THE INVENTION

In most packaging operations, including beverage operations, containers are moved along mechanized conveyor systems in an upright position from station to station wherein various operations including filling, labeling, sealing, capping, and the like are performed on the containers. During some of the operations, the containers are open. In particular in the beverage industry, it is important that the containers move without hindrance along the conveyor such that no liquid is spilled onto the conveyor. This is particularly important for dairy based beverages such as milk because milk can coagulate on the equipment surfaces.

Such conveyor systems are thus typically lubricated to reduce friction between the package and the load bearing surface of the conveyor. Thus, these lubricants are typically applied to the conveyor belts to reduce friction between the package and the conveyor which facilitates unhindered conveyance of bottles on the conveyor belt. These lubricants, may also be referred to as chain conveyor or belt lubricants.

Not only are good lubricating properties important, there are other important considerations when selecting a lubricant for use in the beverage bottling industry. One such consideration is that the lubricant be compatible with the beverage such that it does not form coagulates or other solid deposits when it accidentally contacts spilled beverages on the conveyor system. The lubricant must also be readily cleaned from the equipment.

In the past, the lubricants commonly used on the load bearing surfaces of these conveyor systems typically contained fatty acid soaps as the active lubricating ingredient.

These fatty acid lubricants provided excellent lubricity, but are also known for forming insoluble precipitates in the presence of cations found in hard water such as calcium and magnesium. These precipitates can cause clogging of nozzles and subsequent loss of lubricant flow to conveyor surfaces. Water softening agents and chemical chelating or sequestering agents such as EDTA can be employed with these lubricants to prevent formation of such precipitates. However, strong chelating agents such as EDTA are also known for leaching calcium out of concrete which causes pitting in the concrete floor surfaces which are commonly found in beverage plants and dairy operations.

Amine-based lubricants are known and may be used as an alternative lubricant to the fatty acid based lubricants for lubricating conveyor systems. However, amine based lubricants tend to form precipitates with polyvalent anions such as carbonates and sulfates which are also present in hard water. This can lead to clouding of the lubricant solution. Furthermore, amine-based lubricants have been known to cause coagulation of milk which; is a disadvantage for use in dairy conveyor operations. The coagulation of milk results in soil build-up on equipment and environmental surfaces. This soil is aesthetically unappealing, difficult to clean and may, for a thorough cleaning, require dismantling of the equipment.

Soil build-up can also cause fouling of moving parts on container filling equipment. Such fouling can become a harbor for bacterial growth and subsequently lead to problems with product quality. More frequent cleaning and longer cleaning times may be required.

Preventing soil build-up resulting from milk coagulation can reduce the amount of time required for cleaning. Dairy operations and beverage plants are typically cleaned once a day providing that no problems arise from interaction between a lubricant solution contacting spilled products.

Consequently, there remains a need in the art for an improved lubricant that not only exhibits excellent lubricity, but which also functions well in hard water, is non-corrosive to soft steel and concrete, and which is compatible with and does not coagulate beverage products such as milk.

SUMMARY OF THE INVENTION

The present invention relates to lubricant concentrates and diluted lubricant use compositions which include an effective lubricating amount of at least one sulfo methyl ester.

Suitably, the sulfo methyl esters have the following general formula:

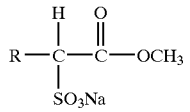

where R=$C_{10}$–$C_{18}$ and more suitably about $C_{12}$–$C_{18}$. In some embodiments, the alkyl group is about $C_{16}$ to about $C_{18}$.

The sulfo methyl ester finds utility and exhibits lubricity at concentrations of about 0.1 to about 75 wt-%, suitably about 0.25 wt-% to about 50 wt-% and most suitably about 0.5 wt-% to about 10 wt-%.

For some applications, diluted use compositions may be in the range of about 0.1 wt-% to about 10 wt-%, and more suitably 0.25 wt-% to about 5 wt-%.

The sulfo methyl ester lubricants may be employed in combination with anti-corrosion agents such as ether diamines and/or dicarboxylic acids or salts thereof. Hard water, particularly well water, has been found to be highly corrosive to mild steel, for example.

Other adjuvants may also be optionally employed in the lubricant compositions according to the present invention. Such adjuvants include, but are not limited to, viscosity modifiers, soil anti-redeposition agents, preservatives, dyes, fragrances, anti-foaming agents, soil suspension and solubilizing agents, penetrants, antimicrobial agents, other surfactants, other hydrotropes, and so forth.

The lubricating compositions according to the present invention exhibit excellent lubricating properties, particularly in hard water conditions such as with well water, are noncorrosive, are non-pitting to both soft steel and concrete, and do not coagulate dairy products such as milk. This superior combination of properties makes the inventive lubricants highly desirable for use as lubricants in food and beverage operations.

The lubricating compositions according to the present invention are advantageously employed as conveyor lubricants in food and beverage operations. They have been found to be particularly useful as dairy conveyor lubricants because, unlike prior lubricants, they do not cause coagulation of milk.

The lubricating compositions according to the present invention are typically prepared as concentrates, and then diluted to an end use concentration prior to use.

The present invention further relates to methods of using the lubricant compositions according to the present invention. One such method includes lubricating a continuously-moving conveyor, system for transporting packages wherein the conveyor system is wetted with an aqueous lubricant composition including the sulfo methyl ester according to the present invention.

The lubricant composition may be provided to the end user as a concentrate, or the method may include the step of diluting the concentrate prior to application of the concentrate to the desirable location of the conveyor system. The lubricant composition may be applied to the conveyor system using a spray method. Application may involve applying the lubricant to the package itself.

These and other advantages of the present invention will be more readily understood by those skilled in the art from a reading of the following detailed description.

DETAILED DESCRIPTIONS OF THE PREFERRED EMBODIMENTS

While this invention may be embodied in many different forms, there are described in detail herein specific embodiments of the invention. This description is an exemplification of the principles of the invention and is not intended to limit the invention to the particular embodiments illustrated.

The present invention relates generally to a lubricant concentrate, diluted use lubricant compositions and to methods of using the same.

A. The Sulfo Methyl Ester Lubricants

The lubricant compositions of the present invention include at least one sulfo methyl ester. Suitably, the sulfo methyl esters have the following general formula:

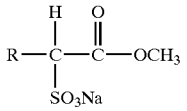

where R=$C_{10}$–$C_{18}$.

In some embodiments according to the present invention, the alkyl group is about $C_{16}$–$C_{18}$. Such longer alkyl chains have been found to provide excellent lubricity.

Additionally, a certain amount of disodium 2-sulfo $C_{12}$–$C_{18}$ fatty acids are present. These fatty acids have the following general formula:

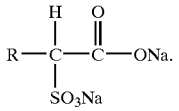

Increase lubricity can be achieved with longer alkyl chains at lower concentrations. However, longer alkyl chains also tend to decrease the solubility of the sulfo methyl ester.

An example of a commercially available sulfo methyl ester is ALPHA-STEP@ MC-48 available from Stepan. The alkyl chain, R, has from 12 to 18 carbon atoms.

The concentrates are typically diluted with water in the range of about about 1 to about 1000, 1 to about 500 and more suitably about 1 to about 200.

The sulfo methyl ester concentrate finds utility and exhibits lubricity at concentrations of about 0.1 to about 75 wt-%, suitably about 0.25 wt-% to about 50 wt-% and most suitably about 0.5 wt-% to about 10 wt-%.

For some applications, diluted use compositions may be in the range of about 0.1 wt-% to about 10 wt-%, and more suitably 0.25 wt-% to about 5 wt-%.

B. Corrosion Inhibitors:

The sulfo methyl ester lubricants of the present invention may be advantageously used in combination with corrosion inhibitors. Examples of such corrosion inhibitors include, for example, ether amines, polycarboxylic acids such as carboxylic diacids, triacids, as well as the phosphate esters, or other salts, including sodium or potassium salts, thereof.

The present inventors have found that when at least one sulfo methyl ester lubricant is employed in combination with at least one ether amine and/or at least one polycarboxylic acid or salt thereof, and preferably both, the lubricant composition prevents corrosion of mild steel. For stainless steel, anti corrosion agents, in particular the dicarboxylic acid, provide no further benefits.

The ether amines suitable for use herein include linear and branched, and saturated and unsaturated alkyl ether amine compounds.

Suitable ether amines and diamines include those having the following general formulas:

$$R_1—O—R_2—NH_2 \quad \text{and} \quad R_1—O—R_2—NH—R_3—NH_2$$

and mixtures thereof, wherein $R_1$ may be linear $C_6$–$C_{18}$, $R_2$ may be a linear or branched $C_1$–$C_{18}$ alkyl, and $R_3$ is a linear or branched $C_1$–$C_8$ alkyl group. Ether diamines such as these are described in commonly assigned U.S. Pat. No. 5,723,418 and U.S. Pat. No. 5,932,526, and in U.S. Pat. No. 6,306,816, each of which is incorporated by reference herein in its entirety.

More specific examples of suitable ether diamine anti-corrosion agents are those having the following general formula:

$$ROC_3H_6NHC_3H_6NH_2$$

where are R is a straight or branched chain alkyl group having from about 8 to about 30 carbon atoms. Examples of such ether diamines include, but are not limited to, octyl/decyloxypropyl-1,3-diaminopropane; isodecyloxypropyl-1,3-diaminopropane; isododecyloxypropyl-1,3-diaminopropane available from Tomah Products, Inc. under the tradename DA-16; dodecyl/tetradecyloxypropyl-1,3-diaminopropane; isotridecyloxypropyl-1,3-diaminopropane available from Tomah Products, Inc. under the tradename DA-17; tetradecyloxypropyl-1,3-diaminopropane available from Tomah Products, Inc. under the tradename of DA-18; and so forth; to mention only a few.

Another specific example of a commercially available ether amine is TOMAH® DA1618 which is a mixture of 60% N-dodecyloxypropyl-1,3-diaminopropane and N-tetradecyloxypropyl-1,3-diaminopropane available from Tomah Products, Inc. and having the following general formula:

$$ROCH_2CH_2CH_2NHCH_2CH_2CH_2NH_2$$

where R is an alkyl group having 12 and 14 carbon atoms.

Suitable examples of polycarboxylic acids or salts thereof are those having the following general formula:

$$HOOC—R—COOH$$

where R is an alkyl group having from about 1 to about 8 carbon atoms and more suitably about 1 to about 4 carbon atoms.

In some embodiments, the corrosion inhibitors are polycarboxylic acids such as dicarboxylic acids. Examples of useful dicarboxylic acids include, but are not limited to, adipic acid, glutaric acid, succinic acid or mixtures thereof. In one embodiment, a mixture of adipic acid, glutaric acid and succinic acid The corrosion inhibitors are useful at concentrations of about 0.05% to about 25% and more suitably about 0.1% to about 20% in the concentrate. In one embodiment, the concentration of the corrosion inhibitor is about 0.5 wt-% to about 3 wt-%.

One example of a useful corrosion inhibitor is SOKALON® DCS diacid mixture available from BASF, Inc.

In one embodiment, an ether diamine is employed in combination with a mixture of diacids.

C. High Pressure Additives

The sulfo methyl ,ester lubricants of the present invention may be advantageously used in combination with ether carboxylates. The present inventors have found that when at least one ether carboxylate is employed, the high pressure lubricity is enhanced. Examples of useful ether carboxylates are those having the following general formula:

$$R—(OCH_2CH_2)_n—OCH_2COO—X$$

where X is an alkali metal, amine, ether diamine, ammonium salt or H (free acid), $R=C_{12}–C_{18}$ and more suitably $R=C_{13}–C_{16}$ and n is about 6 to about 18.

High pressure lubricity, such as that required for in-floor conveyors in dairy operations, has been found to be enhanced through the use of ether carboxylates. High pressure lubricity can be measured using a Falex testing instrument. The ether carboxylate is useful from about 0.1 wt-% to about 50 wt-% of the concentrate, more suitably about 0.25 wt-% to about 25 wt-% and most suitably about 0.5 wt-% to about 5 wt-%.

Specific examples of ether carboxylates useful herein include, but are not limited to, trideceth-7-carboxylic acid available from Clariant Corp. under the tradename of SANDOPAN® DTC acid; laureth-5-carboxylic acid available from Clariant Corp. under the tradename of SANDOPAN® LA-8-HC; trideceth-19-carboxylic acid available from Clariant Corp. under the tradename of SANDOPAN® JA-36; branched nonylphenol ethoxylate-9-carboxylic acid available from Clariant Corp. under the tradename of SANDOPAN® MA-18; sodium ceteth-13-carboxylate available from Clariant Corp. under the tradename of SANDOPAN® KST-A; sodium laureth-13-carboxylate having the following general formula $$R—(OCH_2CH_2)_n—OCH_2COO—X$$

where R is an alkyl group having 12 and 15 carbon atoms, n is 12 and X is sodium available from Clariant Corp. under the tradename of SANDOPAN® LS-24.

D. Surfactants

Other surfactants may be optionally employed in the lubricant concentrates and diluted-use compositions of the present invention. Such surfactants should be selected and employed in amounts such that the properties of the lubricant according to the present invention, such as the non-coagulation of milk, for example, are not negatively impacted. Such surfactants are known to those of ordinary skill in the art.

E. Hydrotropes

Other hydrotropes may be optionally employed in effective amounts in the lubricant concentrates and diluted-use compositions according to the present invention to provide viscosity control and cold temperature stability of the concentrate. Examples of optional hydrotropes include, but are not limited to, the alkali salts of aromatic sulfonates including sodium linear alkyl naphthalene sulfonate, potassium linear alkyl naphthalene sulfonate, sodium xylene sulfonate, potassium xylene sulfonate, potassium or sodium toluene sulfonate, potassium or sodium cumene sulfonate, and so forth; n-octenyl succinic anhydride (NOS); ammonium cumene sulfonate; alkyl polyglucoside; and so forth. The above list is intended for illustrative purposes only and is not exhaustive. Hydrotropes are known to those of skill in the art and there are numerous types available for use.

E. Antimicrobial Agents.

It may be desirable to improve antimicrobial efficacy by adding, in addition to the other ingredients, one or more antimicrobial agents. Generally, any solid or liquid chemical agent having microbiocidal efficacy may be used in the invention. Chemical compositions known to impart microbiocidal efficacy include iodophors, phenolics, quaternary ammonium compounds, and so forth.

More specific examples of antimicrobial agents include, but are not limited to, cationic surfactants such as alkyl and benzyl quaternary compounds like N-alkyl ($C_{12-18}$) dimethylbenzyl ammonium chloride, N-alkyl ($C_{14-18}$) dimethylbenzyl ammonium chloride, N-tetradecyldimethylbenzyl ammonium chloride monohydrate, dimethyl didecyl ammonium chloride, and N-alkyl ($C_{12-14}$) dimethyl 1-naphthylmethyl ammonium chloride which are available commercially from manufacturers such as Stepan Chemical Company, and so forth. The above lists are not exhaustive and are intended for illustrative purposes only. One of ordinary skill in the art has knowledge of such antimicrobial agents.

When present, an antimicrobial agent must have a concentration effectively necessary for the required action to be provided. Generally, in the lubricant concentrate the concentration of antimicrobial agent may range from about 0.1 to 10 wt-%, preferably from about 1 to 8 wt-%, and most preferably from about 2 to 6 wt-%.

F. Other Adjuvants

The lubricant concentrate and, in turn, lubricant use-composition of the invention may also include one or more other adjuvants to modify the character or properties of the compositions. Examples of other commonly employed adjuvants include viscosity modifiers, soil anti-redeposition agents, preservatives, dyes, fragrances, anti-foaming agents, soil suspension and solubilizing agents, as well as penetrants, and so forth. One of ordinary skill in the art is well versed in the type of adjuvants employed in such lubricant compositions.

The lubricant use-compositions of the present invention may be formulated as concentrates, and then later diluted to the lubricant use-composition, the dilution depending on the application for which the lubricant use-composition is being employed. Generally, the lubricant concentrate may be diluted with water anywhere from about 1 to about 1,000 times, and more suitably about 1 to about 400, and even more suitably about 1 to about 200 times, to provide the lubricant use-dilution which is desirable.

The sulfo-methyl ester based lubricants of the present invention function excellently in hard water, and thus require no chelating or sequestering agents to prevent precipitates from forming in hard water environments. The sulfo methyl ester based lubricant according to the present invention has been found to provide water hardness compatibility for the lubricant solution with water containing as much as 20 grains of water hardness without any chelating or sequestering agents. This is beneficial because strong chelating agents such as EDTA, for example, have been found to remove calcium and other cations from concrete leading to pitting of the concrete. Thus, being free from strong chelating or sequestering: agents is also an added advantage.

Another advantage of using the sulfo methyl ester based lubricants according to the present invention is that they do not cause coagulation of dairy products, particularly milk.

The lubricant compositions according to the present invention may be employed as conveyor lubricants for conveyor systems which move product or packages along the conveyor system through a series of operations which are performed on each package. These lubricants are sometimes referred to in the industry as belt lubricants. The lubricant compositions of the present invention find particular utility in conveyor beverage and food operations, particularly bottling type operations, wherein packages or bottles are moved via a conveyor through a series of operations including filling, capping, and so forth. Such packages or bottles are typically open during some of the operations and are thus moved along the conveyor while open.

The lubricants may be provided to the end user as a concentrate which requires dilution according to a set of instructions to a diluted use composition, or the lubricants may be provided in an already diluted, ready-to-use form.

The lubricants may be applied to the desirable location using a variety of application methods. One typical method involves spraying the diluted use lubricant composition onto the conveyor system. This may involve a series of spray heads located along the conveyor system.

The lubricating compositions facilitate the unhindered movement of containers along the conveyor system. This is particularly important in beverage operations such as bottling operations, particularly for the dairy industry. Spilled beverages can result in having to shut down the operation for cleaning, thus, the unhindered movement of the bottles along the conveyor system is very important in these operations. Furthermore, it is important that the lubricant be compatible with the spilled beverage such that precipitation, coagulation and solid deposits do not form. The lubricants of the present invention find particular utility in dairy operations because they do not cause coagulation of milk when they come into contact with it.

The lubricant compositions of the present invention may also be applied to the packages which are to be moved along the conveyor, although this is typically a less desirable method.

The following non-limiting examples further illustrate embodiments of the present invention.

EXAMPLES

Test Methods

1. Milk Coagulation 2.5 grams of a 0.5% solution which was prepared with 22 grain per gallon hardness well water was pipetted on to a clean 3×5 inch stainless steel panel at room temperature. One drop of commercial 2% milk, obtained from a local convenience store, was pipetted onto the center of the 0.5% use solution pooled on the panel. The one drop of 2% milk and the 0.5% use solution were allowed to react for five minutes and then poured off the panel. The panel was allowed to dry at room temperature for several minutes and was then checked for appearance. Any signs of residue from coagulation of the milk caused by reaction with the use solution was recorded and photographs were taken.

Failed formulas left a ring of residue around the center where the milk droplet was placed and particles were visible on the panel surface.

Formulas that passed the test did not leave any residue of particles on the panel indicating that the milk did not precipitate from solution.

2. Milk Coagulation 200 g of 0.5% use solution which was diluted with 22 grain per gallon hardness well water was placed in a 600 milliliter beaker. One gram of 2% milk was pipetted into the beaker. The combined solution was covered and left to stand at room temperature for 10 minutes, one hour and in some cases 24 hours. The solutions were observed after 10 minutes. Failed solutions showed precipitated particles on the beaker bottom, and in some cases, particles were floating in solution.

Formulas which passed did not cause precipitation of the milk but merely diluted it and formed a solution with the milk.

3. Milk Coagulation 10.0 grams of 2% milk were placed in 150-milliliter beaker. A 1% use solution of the test formula diluted with 22 grain per gallon hardness well water was prepared. The 1% use solution was added in gram increments that are multiples of ten to the milk and the point at which the 2% milk and 1% use solution mixture reacted to form precipitates was noted. Several minutes were allowed between each addition to observe the mixture for reaction. The solution was observed until either a precipitate formed, or until a relatively large dilution of milk had occurred. The ratio of lubricant solution to milk was 5:1, 10:1 and 15:1 parts of a 1-% use solution to one part of 2% milk.

4. Slider Lubricity Test (DELRIN®; 0.5% in well water; midpoint/bandwidth)

Soft water with $NaHCO_3$ was used to prepare 100 mls of each test lubricant at the target concentration of 0.1 wt-% active amine compound. Soft water or a standard lubricant (0.1% Lubri Klenz® LF available from Ecolab, Inc. in St. Paul, Minn.) may be employed as the control.

The coefficient of friction (COF) for this composition was found to be 1.00 for mild steel on stainless. The formula was tested at 0.1 wt-% in distilled water containing 200 PPM $NaHCO_3$.

The DELRIN®, a thermoplastic prepared from acetal resin slider plate or a polished stainless steel slider plate (20.5 cm in diameter) was cleaned with distilled water and IPA. The chart recorder was turned on for 30 minutes and allowed to warm-up before calibration.

A 50 gram weight was added to the load cell and allowed to hang over the edge of the support. If the pen for the chart recorder did not record at 50, it was adjusted to 50 using the zero control. The weight was then removed and the zero mark adjusted. The pen input was set to 1 Volt and the chart speed set to 1 cm/min.

The plate was connected to an electric motor and the Slider was turned on such that the plate rotated at a steady rate. Solution was applied along the perimeter of the plate. A control was always tested first. To insure proper operation of the instrument and also to insure consistency, a maximum of three experimental lubricants were tested in between each control.

The appropriate rider piece (glass (189 g), mild steel (228 g) or polyethylene terephthalate (PET) disk) was attached to a load cell and placed on the plate in the are wetted by the lubricant solution. When the electric motor was switched on, the disk glided freely on the plate. The Slider plate was allowed to run for 5 minutes or until the force was level. The solution was refreshed 2–3 times during the run. The drag between the glass or mild stainless steel disk and the stainless steel plate was detected by the load cell. The output of the load cell was sent through suitable electronics to the chart recorder.

Various rider pieces may be tested with each lubricant if pertinent. Each lubricant and each rider were noted. The Slider plate was cleaned with distilled water and IPA after each lubricant.

The control may be run before and after each run, and should not be run any less than every 3 runs. The mid-point on the chart recorder relating to net force registered on the load cell should be recorded for comparative lubricity values.

The force between the glass, mild steel or PET rider piece and the stainless steel plate is detected by the load cell and transferred to a chart recorder. The value obtained from the control lubricant before and after the test lubricants is arbitrarily assigned a coefficient of friction (COF) of 1.00. Each trial run is then referenced to the control run, thus resulting in reports of relative COF. The lower the COF value, the better the lubricity. The relative COF was determined using the average force (midpoint of the data collected on the chart recorder) in the following formula:

$$\text{Force}_s/(\text{Force}_{C2}-\text{Force}_{C1})/\text{Run Order}_{C2}-\text{Run Order}_{C1})*(\text{Run order}_S-\text{Run Order}_{C2})+\text{Force}_{C2})$$

where S=sample; C1=control, $1^{st}$ set of data; C2=Control, $2^{nd}$ set of data; 1 is the control lubricant (first set of data); 2–4 are the test lubricants and 5 is a control lubricant (second set of data).

The COF for each lubricant is reported relative to the COF of the control. The lower the COF, the better the lubricity.

Alternatively, a standard may be run before and after each test run. The midpoint value which is equal to the net force from the load cell is recorded from the chart recorder readout, and the midpoint force value of the test sample is compared to the midpoint force value of the standard which are obtained from the chart recorder.

To validate the Slider results, the lubricant can be tested on a short track conveyor with similar control parameters.

5. Slider Lubricity Test (Mild Steel on Stainless Steel/0.5% in Soft Water; Midpoint/Bandwidth)

The same procedure is followed as in Test 4.

6. Recirculated Falex Lubricity Test (ASTM D-2670)/Mild Steel and Soft Water

A Falex Pin & Vee Block Test Machine for friction and wear testing available from Falex Corp. in Sugar Grove, Ill. was used to test lubricity. Two liters of test lubricant solution was prepared in a 4 liter beaker using soft water. The test lubricant was weighed to the nearest 0.01 g.

7. Corrosion Test (Well Water Dip Test: 144 Hours)

Solutions of each test formula were prepared in amounts of 0.8 liters at a concentration of 0.5% in 22 grain per gallon hardness as calcium carbonate (376.2 parts per million as calcium) well water. These solutions were then placed in 1 liter beakers. Fifteen of these solutions were placed in a constant temperature bath. Above each of these solutions a rack was hung with a horizontal panel with rollers running through supports on each end. The panel was raised and lowered by a spring-loaded air driven piston and controlled by a timer. Above each of these solutions a three inch by five inch cold rolled steel corrosion test panel (cold rolled steel; low carbon SAE 1010; ¼hard—(Rockwell B65 to 70); ASTM A-366:QQS-698) from the Q-Panel company of Cleveland, Ohio) was suspended from the horizontal rack. When the immersion portion of the cycle occurred the panels were immersed to a depth of 3½ inches in the solution and 1½ inches of the panels remained dry. The raising and lowering of the panel was controlled by a timer. The timer was set to give eight seconds of immersion followed by one minute of air drying. The cycle was repeated for six days (144 hours). Each panel was visually observed and rated for corrosion. The tests were run at room temperature.

Examples 1–3 and Comparative Examples A

A lubricant concentrate was prepared according to the formula found in table 1.

TABLE 1

| Raw Material | Tradename | Ex 1 | Ex 2 | Ex 3 |
|---|---|---|---|---|
| | Examples 1–3 | | | |
| Water, zeolite softened | | 63.17 | 53.97 | 54.30 |
| Sodium xylene sulfonate, 40% active | | 5.01 | 12.50 | 12.50 |
| $C_{12}$–$C_{14}$ alkyl oxypropyl diamine | TOMAH ® D 16/18 | 2.87 | 2.84 | 2.50 |
| Dicarboxylic acid mixture | SOKALON ® DCS | — | 0.85 | 0.85 |
| Ethoxylated surfactant DTC acid | SANDOPAN ® DTC | — | 2.84 | 2.85 |
| Sulfo methyl ester | ALPHA-STEP ® MC 48 | 21.00 | 27.00 | 27.00 |
| Alkoxylated alkanolamide | NINOL ® 1301 | 7.00 | — | — |
| Glacial acetic acid | | 0.90 | — | — |

SANDOPAN ® DTC is available from Clariant International AG.
TOMAH ® DA 1618 is a ether amine available from Tomah Products, Inc.
SOKALON ® DCS is a mixture of succinic, glutaric and adipic acids and is available from BASF Corp.
ALPHA-STEP ® MC-48 is a sulfo methyl ester having an alkyl group R that has from 12 to 18 carbon atoms and is available from Stepan Co.
NINOL ® 1301 is an alkoxylated alkanolamide available from Stepan Co.

Comparative Example A

A commercially available amine-based lubricant, CONADE® 2001, available from Ace Chemical Products, Inc. was tested for comparative purposes. The lubricant was diluted to a use concentration of about 0.5 wt-% in water. The diluted use composition was tested according to the test methods described above.

Several more comparative examples were prepared. The formulas are found in the following table 2.

TABLE 2

| Raw Material | Tradename | B | C | D | E |
|---|---|---|---|---|---|
| | Comparative Examples | | | | |
| Water; Zeolite softened | | 66.51 | 85.90 | 75.29 | 71.29 |
| Ethoxylated surfactant DTC acid | SANDOPAN ® DTC Acid | 2.84 | 9.00 | 8.93 | 8.93 |
| $C_{12}$–$C_{14}$ alkyl oxypropyl diamine | TOMAH ® D16/18 | 2.84 | 4.50 | 2.98 | 2.98 |
| PEG fatty acid diester | MAXLUBE ® 200 | 2.37 | — | — | — |
| Dicarboxylic acid mixture | SOKALON ® DCS | 0.85 | 0.60 | — | — |
| Alkoxylated alkanolamide | NINOL ® 1301 | 3.75 | — | — | 4.00 |
| Sulfo methyl ester | ALPHA-STEP ® MC-38 | 11.35 | — | — | — |
| Sodium xylene sulfonate 40% | | 9.46 | — | 12.80 | 12.80 |

TABLE 3

| Raw Material | Tradename | F | G | H | I | J |
|---|---|---|---|---|---|---|
| | | Comparative Examples | | | | |
| Water; Zeolite softened | | 71.29 | 71.20 | 68.20 | 70.20 | 73.70 |
| Ethoxylated surfactant | SANDOPAN ® | 8.93 | 8.00 | 3.00 | 6.00 | 9.00 |
| DTC acid | DTC Acid | | | | | |
| $C_{12}$–$C_{14}$ alkyl oxypropyl diamine | TOMAH ® D16/18 | 2.98 | 4.00 | — | 6.00 | 4.50 |
| PEG fatty acid diester | MAXLUBE ® 200 | — | — | — | 5.00 | — |
| Dicarboxylic acid mixture | SOKALON ® DCS | — | — | — | — | — |
| Alkoxylated alkanolamide | NINOL ® 1301 | — | — | 12.00 | — | — |
| Sulfo methyl ester | ALPHA-STEP ® MC-38 | — | — | — | — | — |
| Sodium xylene sulfonate 40% | | 12.80 | 12.80 | 12.80 | 12.80 | 12.80 |
| TEA | | 4.00 | 4.00 | 4.00 | — | — |

TABLE 4

| Raw Material | Tradename | K | L | M | N | O |
|---|---|---|---|---|---|---|
| | | Comparative Examples | | | | |
| Water; Zeolite softened | | 56.14 | 55.23 | 65.70 | 42.50 | 63.00 |
| Ethoxylated surfactant | SANDOPAN ® | 1.54 | 1.23 | — | — | — |
| DTC acid | DTC Acid | | | | | |
| $C_{12}$–$C_{14}$ alkyl oxypropyl diamine | TOMAH ® D16/18 | — | — | — | — | — |
| PEG fatty acid diester | MAXLUBE ® 200 | 5.00 | 4.00 | — | — | — |
| Dicarboxylic acid mixture | SOKALON ® DCS | — | — | — | — | — |
| Alkoxylated alkanolamide | NINOL ® 1301 | 5.15 | 4.12 | 13.30 | — | 17.00 |
| Sulfo methyl ester | ALPHA-STEP ® MC-38 | 22.75 | 22.00 | — | 45.00 | — |
| Sodium xylene sulfonate 40% | | 9.42 | 9.42 | 16.00 | 12.50 | 20.00 |
| TEA | | 4.00 | 4.00 | — | — | — |
| | BARDAC ® 2250 | — | — | 5.00 | — | — |

Various testing was performed for each composition, the results of which are shown in Tables 5–8 below.

TABLE 5

| Example | 1. Milk Coagulation steel panel | 2. Milk Coagulation 600 ml beaker | 3. Milk Coagulation 150 ml beaker |
|---|---|---|---|
| | Test Results | | |
| 1 | Pass | Pass | 15:1 no curds |
| 2 | Pass | Pass | — |
| 3 | Pass | Pass | — |
| A | Fails 4:1 ratio curds | Fails 2:1 ratio curds | Fails 2:1 ratio curds |
| B | Pass | Pass | 8:1 no curds |
| C | Fail | Fail | 5:1 no curds 10:1 curds |
| D | Fail | Fail | 10:1 no curds |

TABLE 5-continued

| Example | 1. Milk Coagulation steel panel | 2. Milk Coagulation 600 ml beaker | 3. Milk Coagulation 150 ml beaker |
|---|---|---|---|
| | Test Results | | |
| E | Fail | Fail | 10:1 no curds |

TABLE 6

| Example | 1. Milk coagulation steel panel | 2. Milk Coagulation 600 ml beaker | 3. Milk Coagulation 150 ml beaker |
|---|---|---|---|
| | Test Results | | |
| F | Fail | Fail | 10:1 no curds |
| G | Fail | Fail | 10:1 no curds |
| H | Pass | Pass | 10:1 no curds |
| I | Fail | Fail | 5:1 no curds 10:1 no curds |
| J | Fail | Fail | 5:1 no curds 10:1 curds |
| K | Pass | Pass | — |
| L | Pass | Pass | — |
| M | Fail | Fail | — |
| N | Pass | Pass | — |
| O | Fail slight flock | Fail slight flock | — |

TABLE 7

| Example | SliderLubricity Delron 0.5% use soln | Slider Lubricity mild steel on stainless (0.5% use solution) | Recirculated Falex Lubricity | Corrosion Test/ Well water dip test (0.5% use solution) |
|---|---|---|---|---|
| | Test Results | | | |
| 1 | | 32.0/4.0 | Pass @ 1.00% | <1% rust; very good |
| 2 | — | 30.5/9.0 | Pass @ 1.00% | <1% rust; very good |
| 3 | — | 39.0/2.0 | Pass @ 0.50% | — |
| A | 43.5/7.0 47.0/1.0 43.5/3.0 | 32.7/4.6 (average of 5 runs) | Pass @ 0.3% | 1–2% rust; very good |
| B | >50 and rising cloudy/could not test | 31.75/4.5 | Fail @ 1% | <1% rust; very good |
| C | 42.75/2.50 | 32.5/4.0 | Fail @ 0.75% | 1–2% rust; very good |
| D | 36.0/4.0 | 33.25/4.50 | Fail @ 0.75% | <1% rust; very good |
| E | 31.8/2.4 | 32.75/4.50 | Fail @ 0.75% | 2–3% rust; good |
| F | | | — | <1% rust; very good |

TABLE 8

| Example | SliderLubricity Delron (0.5% use solution) | Slider Lubricity mild steel on stainless (0.5% use solution) | Recirculated Falex Lubricity | Corrosion Test/ Well water dip test (0.5% use solution) |
|---|---|---|---|---|
| | Test Results | | | |
| G | 45.2/3.6 | 34.5/5.0 | — | <1% rust; very good |

TABLE 8-continued

Test Results

| Example | SliderLubricity Delron (0.5% use solution) | Slider Lubricity mild steel on stainless (0.5% use solution) | Recirculated Falex Lubricity | Corrosion Test/ Well water dip test (0.5% use solution) |
|---|---|---|---|---|
| H | 42.5/8.0 | Too noisy | Fail @ 0.75% | <1% rust; very good |
| I | >50 and rising | 33.5/5.0 | — | <1% rust; very good |
| J | — | 32.5/5.0 | — | 2–3% rust; good |
| K | — | 32.5/5.0 | Fail @ 0.75% | Moderate; 25% rust |
| L | — | 32.5/7.0 | Fail @ 1.00% | Moderate; 25% rust |
| M | — | Too noisy; no results | — | 100% rust; very bad |
| N | — | 29.5/9.0 | Fail @ 1.00% | 15% heavy/ 85% light rust; very bad |
| O | — | Too noisy; no results | Fail @ 1.00% | 100% rust; very bad |

The above disclosure is intended for illustrative purposes only and is not exhaustive. The embodiments described therein will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A lubricant concentrate comprising an effective lubricating amount of at least one sulfo methyl ester and at least one ether carboxylate.

2. The lubricate concentrated of claim 1 wherein said sulfo methyl ester has the formula:

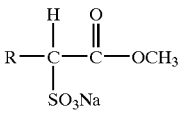

where R=$C_{10}$–$C_{18}$.

3. The lubricant concentrate of claim 2 wherein R=$C_{12}$–$C_{18}$.

4. The lubricant concentrate of claim 2 wherein R=$C_{16}$–$C_{18}$.

5. The lubricant concentrate of claim 1 wherein said sulfo methyl ester is present at a concentration of about 0.1 wt-% to about 75 wt-%.

6. The lubricant concentrate of claim 1, wherein said sulfo methyl ester is present at a concentration of about 0.25 to 50 wt-%.

7. The lubricant concentrate of claim 1, wherein said sulfo methyl ester is present at a concentration of about 0.5 wt-% to about 10 wt-%.

8. The lubricant concentrate of claim 1 further comprising at least one ether diamine, at least one dicarboxylic acid or salt thereof, or mixtures thereof.

9. The lubricant concentrate of claim 1 further comprising at least one ether diamine and at least one dicarboxylic acid.

10. The lubricant concentrate of claim 9 wherein said ether diamine is selected from the group consisting of

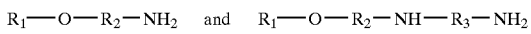

and mixtures thereof, wherein $R_1$ may be linear $C_6$–$C_{18}$, $R_2$ may be a linear or branched $C_1$–$C_8$ alkyl, and $R_3$ is a linear or branched $C_1$–$C_8$ alkyl group.

11. The lubricant concentrate of claim 9 wherein said at least one ether diamine is selected from the group consisting of isododecyloxypropyl-1,3-diamino propane, dodecyloxypropyl-1,3-diamino propane, tetradecyloxypropyl-1,3-diamino propane, isotridecyloxypropyl-1,3-diaminopropane and mixtures thereof.

12. The lubricant concentrate of claim 9 wherein said at least one ether diamine is a mixture of dodecyloxypropyl-1,3-diaminopropane and tetradecyloxypropyl-1,3-diaminopropane.

13. The lubricant concentrate of claim 9 wherein said dicarboxylic acid or salt thereof has the following general formula:

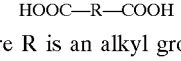

where R is an alkyl group having from about 1 to about 8 carbon atoms.

14. The lubricant concentrate of claim 13 further in combination with an ether amine or diamine having the following general formula:

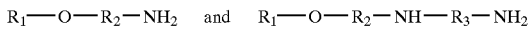

and mixtures thereof, where $R_1$ is linear $C_6$–$C_{18}$, $R_2$ is linear or branched $C_1$–$C_8$ alkyl, and $R_3$ is linear or branched $C_1$–$C_8$ alkyl group.

15. The lubricant concentrate of claim 1 wherein said ether carboxylate has the following general formula:

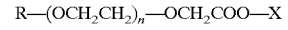

where X is an alkali metal, amine, ether diamine, ammonium salt or H (free acid), R=$C_{12}$–$C_{18}$ and mare suitably R=$C_{13}$–$C_{16}$ and n is about 6 to about 18.

16. The lubricant concentrate of claim 1 wherein said ether carboxylate is present at a concentration of about 0.1 wt-% to about 50 wt-%.

17. The lubricant concentrate of claim 1 further comprising at least one member selected from the group consisting of surfactants, hydrotropes, antimicrobial agents, viscosity modifiers, soil anti-redeposition agents, preservatives, dyes, fragrances, anti-foaming agents, soil suspension agents, solubilizing agents, penetrants, and mixtures thereof.

18. A lubricated conveyor or container, having a lubricant coating on a container-contacting surface of the conveyor or on a conveyor-contacting surface of the container, wherein the coating comprises the lubricant composition of claim 1.

19. An aqueous conveyor lubricant composition comprising from about 0.1 wt-% to about 10 wt-% of at least one sulfo methyl ester having the following general formula:

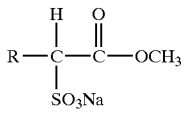

where R=$C_{10}$–$C_{18}$ and at least one ether carboxylate.

20. The aqueous conveyor belt lubricant composition of claim 19 comprising about 0.25 wt-% to about 5 wt-% said at least one sulfo methyl ester.

21. The aqueous conveyor belt lubricant composition of claim 19 further comprising at least one ether diamine, at least one dicarboxylic acid or salt thereof, or mixtures thereof.

22. A method of lubricating the interface between a container and a moving conveyor surface, the method comprising the steps of:

a) providing a lubricant composition comprising at least one sulfo methyl ester and at least one high pressure additive; and b) applying said lubricant composition to said conveyor surface.

23. The method of claim 22 wherein said applying step comprises applying said lubricant composition to said conveyor by means of a plurality of spray nozzles spaced along said conveyor system.

24. The method of claim 22 wherein said lubricant composition is in the form of a concentrate.

25. The method of claim 24 further comprising the step of diluting said concentrate with water at a ratio of about 1 to about 1000 parts water to 1 part concentrate.

26. The method of claim 24 further comprising the step of diluting said concentrate water at a ratio of about 1 to about 500 parts water to about 1 part concentrate.

27. The method of claim 22 wherein said at least one sulfo methyl ester has the following formula:

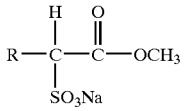

where R=$C_{10}$–$C_{18}$.

28. The method of claim 27 wherein R=$C_{12}$–$C_{18}$.

29. The method of claim 27 wherein R=$C_{16}$–$C_{18}$.

30. The method of claim 22 wherein said lubricant composition further comprises at least one ether diamine, at least one dicarboxylic acid or salt thereof, or mixtures thereof.

31. A method of lubricating a conveyor system comprising the steps of a) diluting a lubricant concentrate with water to form an aqueous lubricant use-solution comprising an effective lubricating amount of at least one sulfo methyl ester and at least one high pressure additive; and b) applying said lubricant use-solution composition to the intended surface of use.

32. The method of claim 31 wherein said sulfo methyl ester has the following general formula:

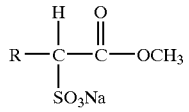

where R=$C_{10}$–$C_{18}$.

33. The method of claim 31 wherein said lubricant composition further comprises at least one ether diamine, at least one dicarboxylic acid or salt thereof, or mixtures thereof.

34. A method for lubricating a continuously-moving conveyor system for transporting packages said conveyor system is wetted with an aqueous lubricant composition comprising a sulfo methyl ester having the following general formula:

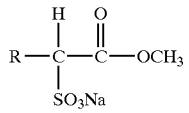

where R=$C_{10}$–$C_{18}$.

35. The lubricant concentrate comprising an effective lubricating amount of at least one sulfo methyl ester and at least one high pressure additive.

36. The lubricant concentrate of claim 35 further comprising at least one corrosion inhibitor.

37. A lubricant concentrate comprising an effective lubricating amount of a least one sulfo methyl ester and at least one corrosion inhibitor.

38. The lubricant concentrate of claim 36 wherein said at least one corrosion inhibitor is an ether diamine, a dicarboxylic acid or salt thereof, or a mixture thereof.

39. An aqueous conveyor lubricant composition comprising from about 0.1 wt-% to about 10 wt-% of at least one sulfo methyl ester having the following general formula:

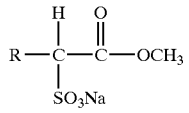

where R=$C_{10}$–$C_{18}$ and at least one ether diamine, at least one dicarboxylic acid or salt thereof, or mixture thereof.

40. The method of claim 22 wherein said at least one high pressure additive is an ether carboxylate.

41. The method of claim 31 wherein said at least one high pressure additive is an ether caboxylate.

* * * * *